United States Patent [19]

Zimba

[11] Patent Number: 4,889,344

[45] Date of Patent: Dec. 26, 1989

[54] DICTIONARY GAME

[76] Inventor: Kenneth P. Zimba, 19860 Lakeview Ave., Excelsior, Minn. 55331

[21] Appl. No.: 266,003

[22] Filed: Nov. 2, 1988

[51] Int. Cl.[4] ..... A63F 3/00

[52] U.S. Cl. ..... 273/243; 273/272; 434/167

[58] Field of Search ..... 273/243, 248, 249, 1 R; 434/167, 170, 171, 172, 176, 327

[56] References Cited

U.S. PATENT DOCUMENTS

| | | | |
|---|---|---|---|
| 1,635,735 | 7/1927 | Ziegler . | |
| 1,755,853 | 4/1930 | Waring . | |
| 3,939,578 | 2/1976 | Coffey | 273/243 X |
| 3,984,106 | 10/1976 | White . | |
| 4,123,051 | 10/1978 | Tsacoyannis | 273/1 R |
| 4,306,725 | 12/1981 | Sawyer | 273/302 |
| 4,416,454 | 11/1983 | Delamontagne | 273/243 |
| 4,519,606 | 5/1985 | Lussiez | 273/1 R |
| 4,557,485 | 12/1985 | Lardon | 273/249 |
| 4,640,513 | 2/1987 | Montijo | 273/249 |
| 4,743,029 | 5/1988 | Consolatore et al. | 273/243 |

*Primary Examiner*—Edward M. Coven
*Assistant Examiner*—William E. Stoll
*Attorney, Agent, or Firm*—Haugen and Nikolai

[57] ABSTRACT

A dictionary game including a game board having a track with a plurality of playing spaces which show letters of the alphabet intermittently alternating with spaces showig bonus stars. The game board also includes card spaces for a plurality of decks of question cards which are coordinated with the letters and symbols on the playing spaces. The game is used with a dictionary. A plurality of decks of question cards, wherein alphabetical characters are printed on the top surface and indicia for selecting a dictionary page number is imprinted on the bottom surface is also included as is a deck of bonus cards whereon questions are imprinted on at least one surface together with page numbers corresponding to the page in the dictionary whereon the answer to the question is contained. Apparatus for determining the progress of the players along the track on the game board is included as are playing pieces.

8 Claims, 2 Drawing Sheets

DICTIONARY GAME

BACKGROUND OF THE INVENTION

The instant invention relates generally to board games and more specifically it relates to a board game using a child's or adult's dictionary game and basing questions thereon resulting in the accumulation of game points.

Numerous board games exist which incorporate questions and answers on various subject matters relating to spelling and/or dictionary definitions of words. The invention combines the use of a dictionary or dictionaries with a player's knowledge of information found in a dictionary, including spelling, word definitions, cities, countries and oceans. The invention combines these intellectual elements with the element of chance while using the game board in a novel manner not present in prior art board games.

SUMMARY OF THE INVENTION

A dictionary game for use with an adult or children's dictionary is disclosed. The game includes a game board having provided thereon a track comprising a plurality of playing spaces, each playing space having indicia thereon including spaces which show letters of the alphabet intermittently alternating with spaces showing bonus stars, and wherein the game board also includes card spaces for a plurality of decks of question cards which are coordinated with the letters and symbols on the playing spaces. A plurality of decks of question cards, each card having top and bottom surfaces wherein alphabetical characters are printed on the top surface and means for selecting a dictionary page number for an adult or children's dictionary is imprinted on the bottom surface. A deck of bonus cards is also included whereon questions are imprinted on at least one surface together with page numbers corresponding to the page in the dictionary whereon the answer to the question is contained. Means for determining the progress of the players along the track on the game board is included as well as a plurality of playing pieces for use by participants of the game.

The primary object of the present invention is to provide a dictionary game that combines the use of a dictionary with a person's knowledge of information contained in the dictionary, including spelling, word definitions, cities, countries and oceans combined with the element of chance while using a game board.

Another primary object of the invention is to provide an educational game in which the players expand on their vocabulary knowledge by spelling and defining selected words in the dictionaries provided.

Another object of the game is to accumulate an agreed upon number of points by the players where both skill and chance are a factor in determining these results.

Still another object is to provide a dictionary game that can be played using an adult or children's dictionary to compensate for the different skill levels depending upon the age group or groups playing the game.

Further objects, features and advantages of the invention will become apparent from consideration of the detailed description of the invention, the claims and drawings herein where like numerals refer to like elements.

DETAILED DESCRIPTION OF THE PREFERRED EMBODIMENTS

Figure 1:
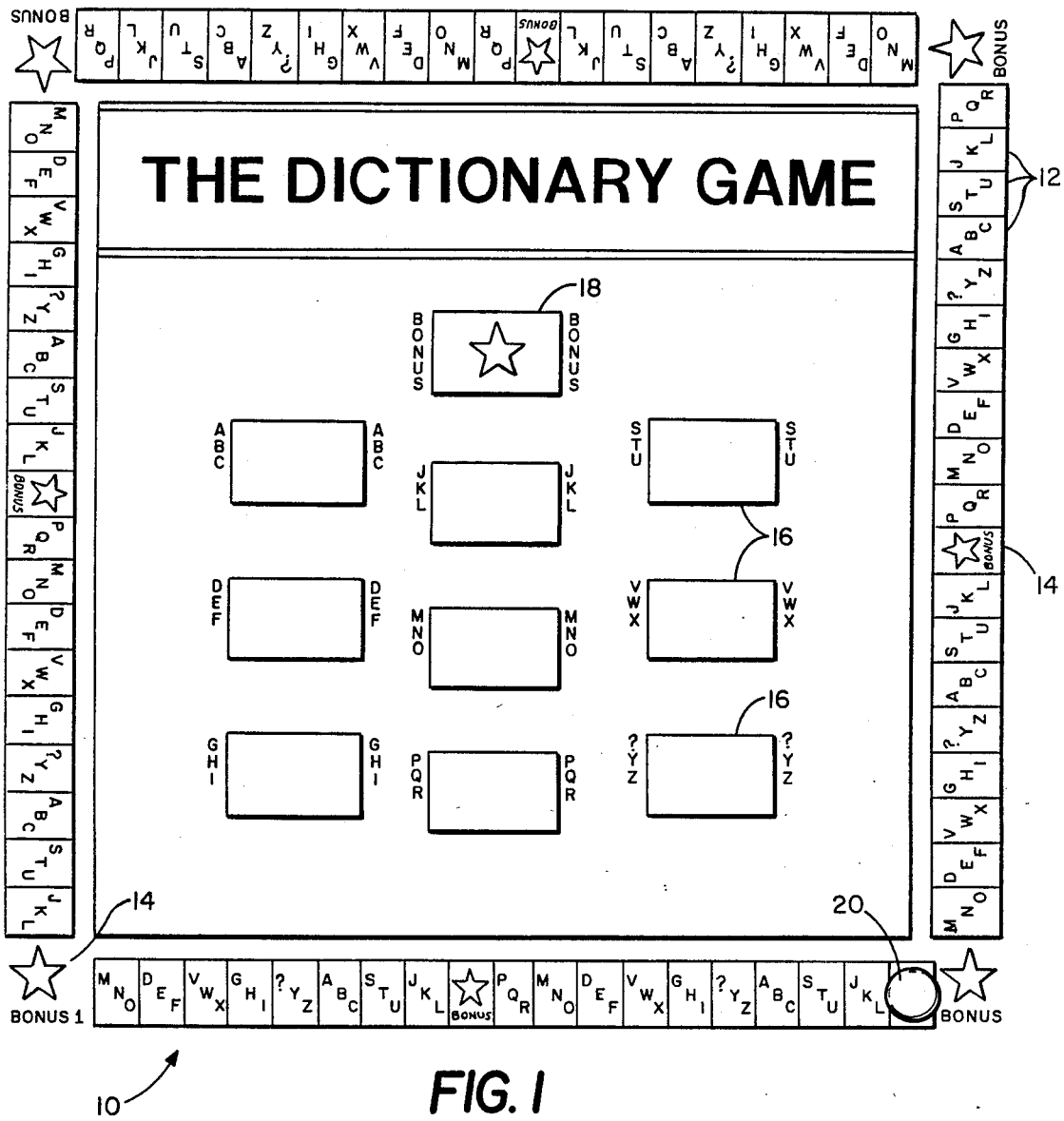
FIG. 1 is a top plan view of a game board of the invention.

Turning now to FIG. 1, the game board 10 of the invention is illustrated. The game board 10 includes a track comprised by a plurality of playing spaces around the perimeter of the game board denoted generally by reference number 12 having indicia thereon representing letters of the alphabet in groupings according to alphabetical order within each playing space. The playing spaces 12 intermittently alternate with spaces showing bonus stars, one of such spaces being indicated by reference number 14 showing a bonus star. The game board may also include card spaces 16 for a plurality of decks of question cards which have indicia thereon corresponding to the indicia on the playing spaces 12. Also included on the game board may be a space for a deck of bonus cards 18. An example of a token 20 which may be used by players playing the game is also shown on FIG. 1.

Figure 2:
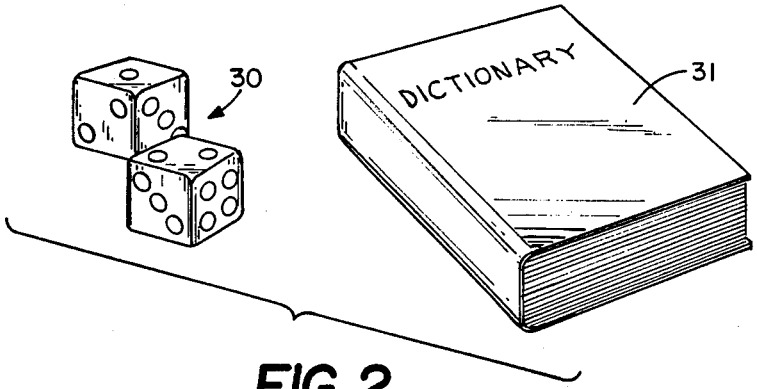
FIG. 2 is a perspective view of dice and a dictionary as used in the game board of the invention.

FIG. 2 shows one means for determining a player's move during his/her turn comprising a pair of dice 30 which is rolled in the well known manner during a player's turn. Also shown in FIG. 2 is a perspective view of a typical dictionary 31 which is employed as part of the invention.

Figure 3:
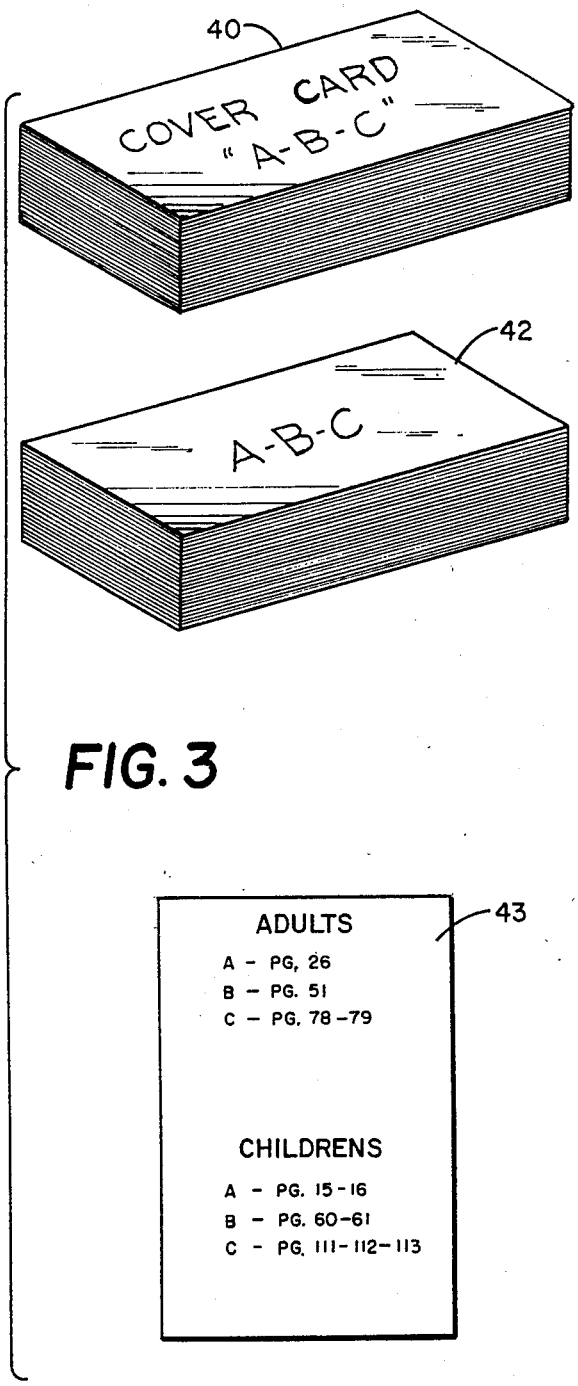
FIG. 3 is a perspective view of a deck of question cards as provided by the invention, including a cover card, the top surface of a question card and a sample of questions on the question card.

FIG. 3 shows a perspective view of decks of question cards as are used in the game, including a typical cover card 40 and a typical top surface of a question card 42 as well as an example of the indicia imprinted on the bottom surface of a typical question card corresponding to letter and page information in either an adult or children's dictionary.

Figure 4:
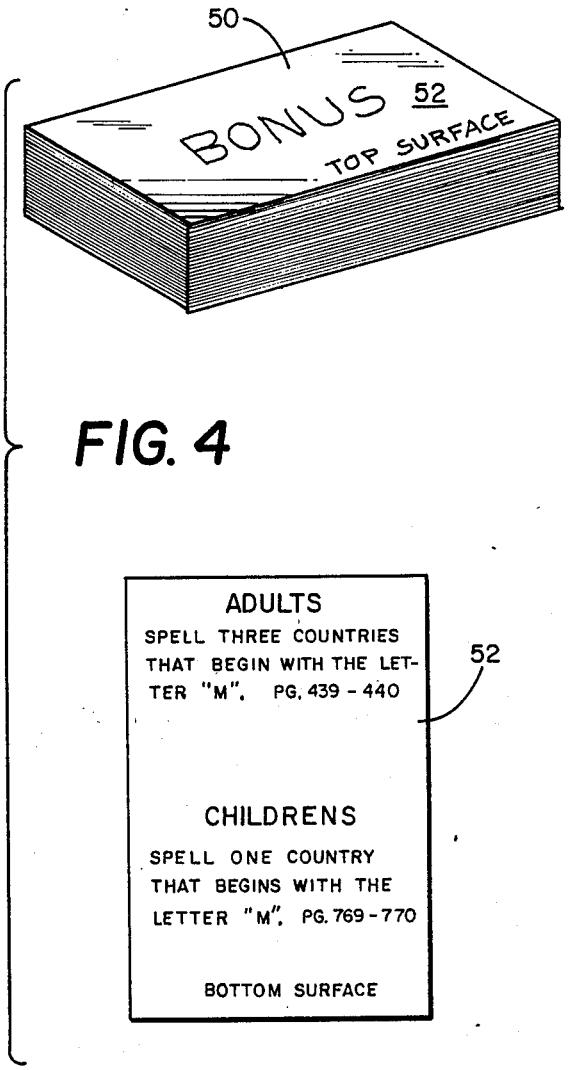
FIG. 4 is a perspective view of a bonus deck as provided by the invention including an example of one bonus card's questions imprinted thereon.

FIG. 4 shows a deck of bonus cards 50, including one example 52 of typical bonus card questions for the adult and children's versions of the game of the invention.

In the preferred embodiment of the dictionary game, the number of decks of questions cards is at least nine, whereon each of eight decks correspond to three alphabetical groups of letters and the ninth deck corresponds to the letters "Y-Z" together with a "?". The card deck marked with "?-Y-Z" includes questions about cities and other categories, such as oceans and other geographical features as well as questions relating to the letters Y and Z. The other card decks are divided into sections with which inference either the adult or children's dictionary. Through a series of plays of the game, the card decks with alphabetic designations are designed to successively lead the players through most or all of the words in the dictionaries. For example, if the "A" section of the dictionary has 20 pages and if there are 10 stacks of game cards, then it could be expected that up to 20 game cards would carry the beginning "A". One "A" card could designate one or more dictionary pages to be subsequently referenced. Similarly, this is possible for the other referenced alphabetical cards.

The card decks 50 marked "BONUS" have questions in various categories, for example, in one embodiment of the game, the questions would be about countries, and the scoring for those cards is somewhat different. Under typical rules of the game, points are given for complete, correct answers. Incorrect or partially correct answers are usually deemed to be worth zero points.

TYPICAL RULES OF THE GAME

As described above, this invention is an educational game using various decks of cards, a game board, a dictionary or dictionaries and a mode of movement around the game board. As the players advance on the game board, letters from the alphabet are selected which correspond to pages in the dictionary or dictionaries. Questions are asked pertaining to the correct spelling and definition of the corresponding selected words in the dictionary or dictionaries. Other categories to select from on the game board utilize a player's knowledge of geographical features, such as cities, countries and oceans. Appropriate points are given for correct answers.

The object of the game is to obtain a cumulative point goal agreed upon by the players prior to commencing the game by correctly spelling and defining chosen words in the dictionary. An adult or children's dictionary or both may be used depending on the age and skill level of the players. In one embodiment of the game, a goal of obtaining 25 to 50 points for winning the game is suggested. The point system is explained below.

Preparation of the game by the players consists of placing the nine decks of cards labeled with alphabetic characters and the one deck labeled "BONUS" on the game board in their appropriately marked areas. Each player then uses one game piece to represent his/her movement around the board.

To start, each player places his/her game piece on the area marked "BONUS 1". The dice is thrown once by each player to determine starting order. The player with the highest total on the dice starts the game. After the first player has completed his/her turn, the play passes to the left. The area marked "BONUS 1" then becomes a regular "BONUS" area to be landed on as the game progresses.

Under typical rules of the game, for each word spelled correctly and for which the correct definition is given by a player, a player will receive six points. Three points are awarded for the correct spelling of the word plus an additional three points for a player giving the correct definition. The competitive level of the players will determine how exact the definition given must be. For example, if the word "daisy" is chosen, an acceptable definition may simply be "a flower". However, more competitive players, may require the definition to be "a small flower with a center different in color to or the same as its pedals".

One adult and one children's dictionary may be provided with each game. As shown in FIGS. 3 and 4, the card decks are divided into two sections. The top half of the card corresponds with the adult's dictionary and the bottom half of the card corresponds to the children's dictionary. Game points are the same for both dictionaries.

To begin play, the first player or team of players rolls the dice and moves the appropriate number of spaces as shown on the dice. The player will land on a BONUS or playing space. The player then draws the question card or BONUS card from the deck corresponding to the indicia on the playing space and selects the letter and page he/she wants from the dictionary. One letter and page number are selected. For example, if the card deck selected is D-E-F, the play choices would be as follows: Adults: D-pp. 112, 113, or E-pg. 135, or F-pp. 153, 154. Children: D-pp. 162, 163, or E-pp. 204, 205, or F-pp. 236, 237. An opposing player or team then selects any word shown on the requested page and asks for the correct spelling and definition. All answered cards are returned to the bottom of their respective decks. In addition to spelling and definition questions as found on the other question cards described above, the card deck marked with "?-Y-Z" has questions about cities and oceans in one example of the game. In these categories, even though the type of question is different, for example, asking for the spelling of an ocean or a city, scoring is still basically the same. Three points are given for the correct city or ocean plus three points for the correct spelling.

If a player lands on an area marked "BONUS", an opponent reads one question from the deck marked "BONUS". Correct answers are worth five points. Incorrect or partially correct answers are worth no points.

If a players rolls doubles on the dice, he/she has one (and only one) extra turn regardless of whether or not he/she rolls doubles on his/her extra turn.

Because some words in the dictionary have more than one correct spelling and definition, only one correct spelling and definition is necessary for a player to score points. All words must be spelled correctly including combination words, for example, "cross-pollination", "cast iron" and "British thermal unit". With respect to abbreviations, all words in full must be spelled correctly, for example, "F.B.I." must be spelled "Federal Bureau of Investigation". It is suggested that the players spend a few minutes reviewing the usage of a dictionary prior to playing the game. The adult's dictionary choices in the example of The Dictionary Game detailed above are from "Webster's New Compact Format Dictionary", Book Essentials Publications. The children's dictionary choices in the example of The Dictionary Game detailed above are from "Webster's II Riverside Children's Dictionary", The Riverside Publishing Company. Of course, the invention can easily be modified to correspond to other kinds and types of dictionaries or similar books.

This invention has been described herein in considerable detail in order to comply with the Patent Statutes and to provide novel principles and to enable those skilled in the art to construct and use such specialized components as are required. However, it is to be understood that the invention can be carried out by specifically different equipment and devices, and have various modifications without departing from the scope of the invention itself.

What is claimed is:

1. A dictionary game for use with an adult or children's dictionary comprising:

(a) a game board having provided thereon a track comprising a plurality of playing spaces, each playing space having indicia thereon including spaces which show letters of the alphabet intermittently alternating with spaces showing bonus stars, and wherein the game board also includes card spaces for a plurality of decks of question cards which are coordinated with the letters and symbols on the playing spaces;

(b) a plurality of decks of question cards, each card having top and bottom surfaces whereon alphabetical characters are imprinted on the top surface and means for selecting a dictionary page number for adult or children's dictionaries is imprinted on at least one surface;

(c) a deck of bonus cards having a top surface and a bottom surface whereon questions are imprinted together with page numbers corresponding to the page in the dictionary wherein the answer to the question is contained;

(d) means for determining the progress of the players along the track; and (e) a plurality of playing pieces for use by participants of the game.

2. The dictionary game of claim 1 wherein the means for determining the progress of players along the track comprise at least two dice.

3. The dictionary game of claim 1 wherein the question cards are divided into nine decks, eight of such decks corresponding to three letters of the alphabet and the ninth deck corresponding to indicia "?-Y-Z" and further where the playing spaces are randomly arranged and each has three alphabet letters or "?-Y-Z" imprinted thereon in correspondence with one of the nine decks.

4. A dictionary game comprising:

(a) a dictionary;

(b) a plurality of decks of question cards, each deck having a cover card and other cards having top and bottom surfaces and further where the cards other than the cover cards have means for selecting a dictionary page number corresponding to one letter selected from the group of letters imprinted on the cover card and corresponding to a page in the dictionary;

(c) a deck of bonus cards, including at least one bonus cover card, each of the bonus cards having questions imprinted on one surface in selected categories together with a page number corresponding to a page in the dictionary containing the answer to the question;

(d) a game board having provided thereon a track comprising a plurality of playing spaces, each of the playing spaces having information corresponding to the information shown on the cover cards for the question card decks randomly interspersed with playing spaces corresponding to the deck of bonus cards;

(e) a plurality of playing pieces for use by participants of the game; and (f) means for determining the progress of the players along the track.

5. The game of claims 1 or 4 wherein the deck of bonus cards has questions pertaining to geography.

6. The dictionary game of claim 4 wherein the means for determining the progress of players along the track comprise at least two die.

7. The dictionary game of claim 4 wherein the question cards are divided into nine decks, eight of such decks corresponding to three letters of the alphabet and the ninth deck corresponding to "?-Y-Z" and further where the playing spaces are randomly arranged and each has three alphabet letters or "?-Y-Z" imprinted thereon in correspondence with one of the nine decks.

8. The game of claims 1 or 4 whereon the game board has further provided marked spaces for placement of the plurality of decks of question cards and the deck of bonus cards.

* * * * *